US008135302B2

(12) United States Patent
Sato et al.

(10) Patent No.: US 8,135,302 B2
(45) Date of Patent: Mar. 13, 2012

(54) IMAGE FORMING APPARATUS HAVING CLEANING DEVICE OF PRE-SECONDARY TRANSFER DISCHARGE UNIT

(75) Inventors: Yotaro Sato, Hachioji (JP); Takenobu Kimura, Hachioji (JP); Hajime Kawakami, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 985 days.

(21) Appl. No.: 12/044,327

(22) Filed: Mar. 7, 2008

(65) Prior Publication Data

US 2008/0247782 A1 Oct. 9, 2008

(30) Foreign Application Priority Data

Apr. 4, 2007 (JP) ..... 2007-098145

(51) Int. Cl.
*G03G 21/00* (2006.01)
*G03G 15/16* (2006.01)

(52) U.S. Cl. ..... 399/99; 399/296

(58) Field of Classification Search ..... 399/99, 399/296

See application file for complete search history.

(56) References Cited

U.S. PATENT DOCUMENTS

| | | | | |
|---|---|---|---|---|
| 6,449,447 | B1 * | 9/2002 | Regelsberger et al. | 399/100 |
| 2006/0198665 | A1 * | 9/2006 | Hamada et al. | 399/296 |
| 2007/0196140 | A1 * | 8/2007 | Kimura et al. | 399/296 |

FOREIGN PATENT DOCUMENTS

| | | |
|---|---|---|
| JP | 04-301862 | 10/1992 |
| JP | 8-202171 A | 8/1996 |
| JP | 9-297457 A | 11/1997 |
| JP | 2006-313194 | 11/2006 |
| JP | 2006-349937 | 12/2006 |

OTHER PUBLICATIONS

Official Action issued in corresponding Japanese Application No. 2007-098145, mailed Nov. 8, 2011, and English translation thereof.

* cited by examiner

*Primary Examiner* — David Gray
*Assistant Examiner* — Andrew Do
(74) *Attorney, Agent, or Firm* — Buchanan Ingersoll & Rooney PC

(57) ABSTRACT

An image forming apparatus including a primary transfer unit to transfer toner images of plural colors on image carriers onto an intermediate transfer member; a secondary transfer unit to transfer the toner images onto a transfer material; and a pre-secondary transfer discharge unit to discharge charges of the toner images, wherein the discharge unit includes a scorotron having a grid electrode and a discharging electrode; an opposing electrode opposed to the grid electrode through the intermediate transfer member; a first voltage unit to apply a reverse polarity voltage of the toner images to the discharging electrode; a second voltage applying unit to apply a same polarity voltage of the toner images to the grid electrode; a cleaning unit of the grid electrode; a current detecting unit; and a controller to control a timing to clean the grid electrode according to the detected current.

6 Claims, 5 Drawing Sheets

IMAGE FORMING APPARATUS HAVING CLEANING DEVICE OF PRE-SECONDARY TRANSFER DISCHARGE UNIT

CROSS-REFERENCE TO RELATED APPLICATION

The present application is based on Japanese Patent Application No. 2007-098145 filed with Japanese Patent Office on Apr. 4, 2007, the entire content of which is hereby incorporated by reference.

BACKGROUND OF THE INVENTION

1. Technical Field

The present invention relates to a copier, a printer, a facsimile machine and an image forming apparatus using an electrophotographic method having the functions of the copier, the printer and facsimile machine. Particularly, the present invention relates to a color image forming apparatus including an intermediate transfer member for superimposing plural color toner images onto the intermediate transfer member to form an image.

2. Description of the Related Art

In the electrophotographic method color image forming apparatus using the intermediate transfer member, known is an image forming apparatus arranged to transfer a toner image formed on an image carrier, which is a photoreceptor onto the intermediate transfer member (primary transfer), then the toner image on the intermediate transfer member is collectively transferred onto a transfer material (secondary transfer). In this type of color image forming apparatus, the color image forming apparatus is designed to superimpose electrostatic toner images, which has been sequentially formed on the image carrier with a predetermined polarity, onto the intermediate transfer member by using static electricity. Then the toner images on the intermediate transfer member are collectively transferred onto the transfer material electrostatically.

Since an electrostatic charge amount per a toner particle is approximately uniform, the electric potential of the toner layer on the intermediate transfer member is determined by the toner adhesion amount in a predetermined area. In the color image forming apparatus, the electrostatic potential of the area where toners of plural colors are superimposed among the toner images of the intermediate transfer member becomes higher than that of the area where one color toner adheres. And for example, when there are a toner image of a solid area and a toner image of a halftone area on the intermediate transfer member, the electrostatic potential of the solid area is higher than that of halftone area.

Dispersion of the electrostatic potential in the image area having passed the primary transfer unit which transfers the toner image onto the intermediate transfer member from the image carrier may be generated according to environments.

As described above, when toner image potential dispersion on the intermediate transfer member is large, areas where transfer characteristics are different with each other exist in the same toner image. When transferring all the areas where the transfer characteristics are different with each other onto the transfer material under the same transfer condition, various poor quality images tend to appear when transferring the toner images from the intermediate transfer member onto the transfer member.

In recent years, in the image forming apparatuses such as the copier, the printer, the facsimile machine and multifunctional peripherals having the function thereof, the ratio of the apparatuses having color capability has increased. At the same time, along with the adoption of polymerization toner and toner having a small diameter, the requirements for high quality images in a transfer process has increased. Further, a high-speed process trend improves in the image forming apparatus. In response to these trends described above, in order to obtain a high quality image, it is necessary to correct the toner potentials on the intermediate transfer member, which vary according to the number of times of the primary transfer and the environment, so as to be approximately uniform, and to improve the second transfer performance.

In the color image forming apparatus for conducting the secondary transfer of a toner image from the intermediate transfer member to the transfer member after superimposing the toner image of each color formed on the surface of a photoreceptor onto the intermediate transfer member by using the primary transfer unit, since the charge amount of the toner on the intermediate transfer member varies according to the number of times of the primary transfer and environments, various image failures tend to be caused.

In the electrophotographic recording apparatus disclosed in Unexamined Japanese Patent Application Publication No. H08-202171 (JPA8-202171), provided is a determination means which determines the contamination in the scorotron based on the electric current amount flowing to the charging wire of the scorotron which being a pre-transfer charging means, the electric current amount flowing to the shield member, and the electric current amount flowing to the grid electrode; and a cleaning means which cleans the charging wire in the scorotron based on the determination of the determination means.

The charging apparatus disclosed in Unexamined Japanese Patent Application Publication No. H09-297457 (JPA9-297457) is provided with a grid cleaning means which cleans the grid by pressing it while being moved by a driving mechanism.

The electrophotographic recording apparatus disclosed in JPA8-202171 is a charging apparatus for charging a photoreceptor with certain amount of discharge, which is able to calculate the discharging amount onto the photoreceptor based on each current value flowing into a charging wire, a shield member and a grid electrode. However, with the charging apparatus, it is difficult to determine the variation of the discharging amount is caused by the dirt of which part of the charging apparatus, among the charging wire, the shield member and the grid electrode. Herein, a cleaning means is for cleaning the charging wire. Since it is difficult to maintain the difference between the electric potential of a toner image after the pre-secondary transfer discharge and the electric potential of the intermediate transfer member substantially constant, it is impossible to stably transfer the toner image on the intermediate transfer member onto a transfer material, which causes deterioration of the toner image quality formed on the transfer material.

In the charging apparatus described in JPA9-29745, cleaning of the grid is conducted, but since the cleaning is periodical, it is conducted irrelevantly to the actual dirt (contamination) of the grid. Therefore, even when frequent image failures are generated, responding action is not taken. Further, if the frequency of the cleaning is increased, the productivity will be decreased and the durability of the grid will be lowered.

An object of the present invention is to provide an image forming apparatus for preventing the degradation of electric potential control ability generated by the dirt on the grid electrode and the image roughening in the halftone area, improving the durability of the grid electrode, and for achieving the improved secondary transfer ability to obtain a high quality secondary transfer image, by correctly detecting the dirt on a grid electrode generated by the adhesion of floating toner in a pre-secondary-transfer discharge unit.

SUMMARY OF THE INVENTION

In order to achieve the above object, an image forming apparatus reflecting one aspect of the present invention includes:

a primary transfer unit to primarily transfer toner images of a plurality of colors onto an intermediate transfer member, the toner images having been formed on a rotating image carrier;

a secondary transfer unit to secondarily transfer the toner images formed on the intermediate transfer member onto a transfer material; and a pre-secondary transfer discharge unit to discharge electrical charges of the toner images carried by the intermediate transfer member, wherein the pre-secondary transfer discharge unit comprises:

a scorotron charging unit having a grid electrode disposed to face the image carrier, and a discharging electrode;

an opposing electrode disposed to oppose the grid electrode through the intermediate transfer member;

a first voltage applying unit to apply a voltage of reverse polarity to a charge polarity of toners forming the toner images to the discharging electrode;

a second voltage applying unit to apply a voltage of same polarity as the charge polarity of the toners to the grid electrode;

a cleaning unit to clean the grid electrode;

a detecting unit to detect an electric current value flowing to the opposing electrode; and a controller to control a timing of cleaning by the cleaning unit to clean the grid electrode in accordance with the electric current value detected by the detecting unit.

BRIEF DESCRIPTION OF THE DRAWINGS

These and other objects, advantages and features of the invention will become apparent from the following description thereof taken in conjunction with the accompanying drawings in which.

DETAILED DESCRIPTION OF THE PREFERRED EMBODIMENT

An embodiment of the present invention will be described below. However, the present invention is not limited to the embodiment to be described below.

<A Color Image Forming Apparatus>

Figure 1:
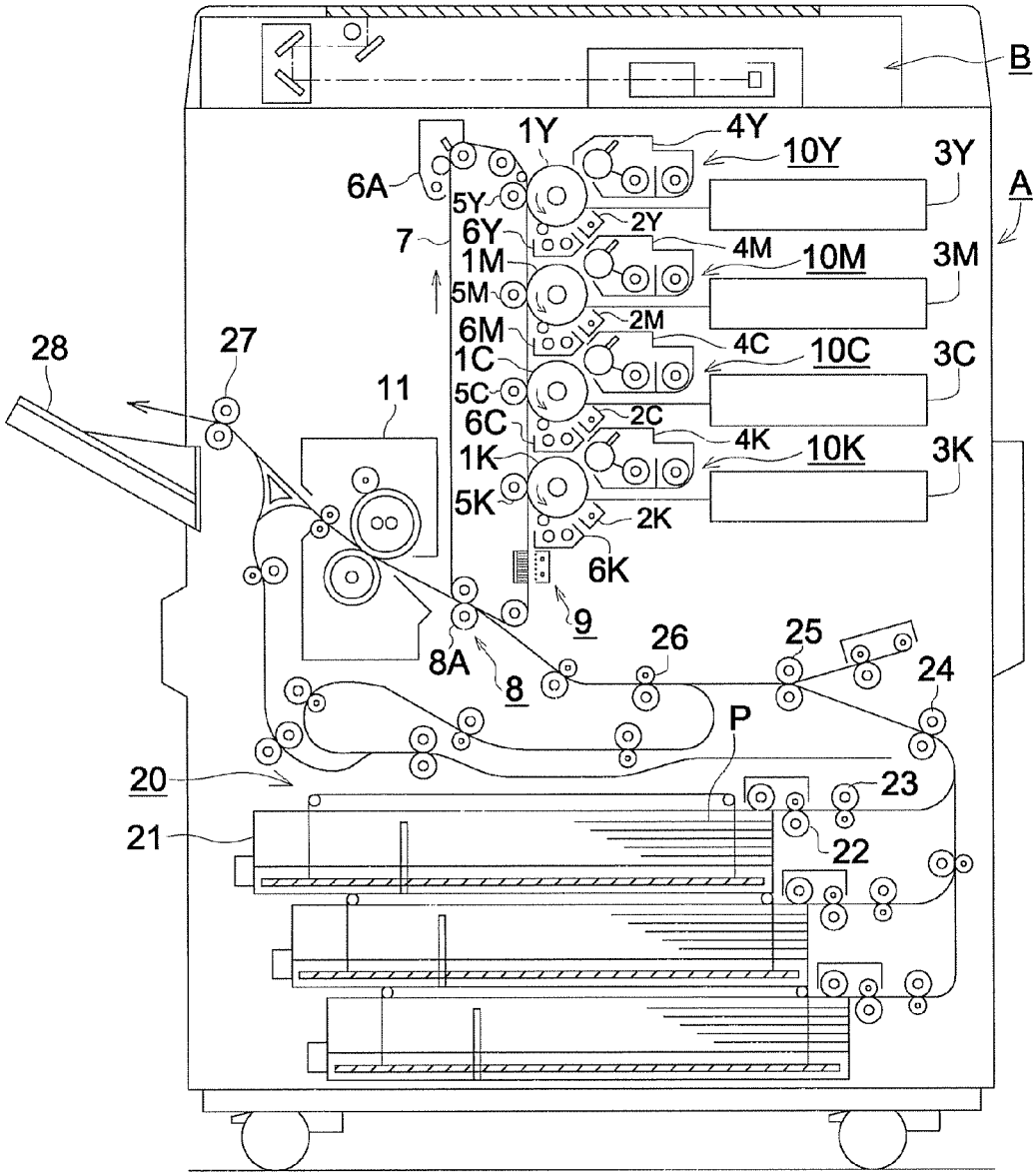
FIG. 1 illustrates a cross sectional view of a total configuration of a color image forming apparatus pertaining to an embodiment of the present invention.

FIG. 1 illustrates a cross sectional view showing a total configuration of an embodiment of a color image forming apparatus A of the present invention.

This color image forming apparatus A is called a tandem type color image forming apparatus. The color image forming apparatus A comprises a plurality of image forming sections 10Y, 10M, 10C and 10K, an intermediate transfer member 7, primary transfer units 5Y, 5M, 5C and 5K, a secondary transfer unit 8, pre-secondary transfer discharge unit 9, a fixing unit 11 and a sheet feeding unit 20.

An optical system of image reading apparatus scans and exposes the document placed on a document table provided at upper area of the color image forming apparatus A. Then a line image sensor reads the image on the document. The line sensor converts the optical image into analog electric signals, which will be inputted into exposure units 3Y, 3M, 3C and 3K after being processed by an analog process, an A/D conversion, a shading correction and an image compression process in an image processing section.

An image forming section 10Y for forming a yellow (Y) colored image comprises a charging unit 2Y, an exposing unit 3Y, a developing unit 4Y and a cleaning unit 6Y, all being disposed on the circumference of an image carrier 1Y.

An image forming section 10M for forming a magenta (M) colored image comprises an image carrier 1M, a charging unit 2M, an exposing unit 3M, an exposing unit 4M and a cleaning unit 6M.

An image forming section 10C for forming a cyan (C) colored image comprises an image carrier 1C, a charging unit 2C, an exposing unit 3C, an exposing unit 4C and a cleaning unit 6C.

An image forming section 10K for forming a black (K) colored image comprises an image carrier 1K, a charging unit 2K, an exposing unit 3K, an exposing unit 4K and a cleaning unit 6K.

A latent image forming section comprises the charging unit 2Y, the exposing unit 3Y, the charging unit 2M, the exposing unit 3M, the charging unit 2C, the exposing unit 3C, the charging unit 2K and the exposing unit 3K.

With regard to the image carriers 1Y, 1M, 1C and 1K, it is preferable that OPC photosensitive material or aSi photosensitive material, which is well known is used. In the embodiment of the present invention, negatively charged OPC is used.

With regard to the charging units 2Y, 2M, 2C and 2K, a corona discharging unit such as a scorotron and a corotron is used. It is preferable that the scorotron discharging unit is used.

With regard to the exposing units 3Y, 3M, 3C and 3K, a light emitting element, such as a LED array for emitting lights according to image data is used.

An intermediate transfer member 7 structured in a belt shape is configured by semi-conductive material. The intermediate transfer member 7 is wound around a plurality of support rollers 71, 72, 73, 74 and a backup roller 75, and is supported so that the intermediate transfer member 7 can circularly move thereabout. In this embodiment, the intermediate transfer member 7 is flatly supported between support rollers 73 and 74.

The primary transfer units 5Y, 5M, 5C and 5K successively transfer each color image formed by the image forming sections 10Y, 10M, 10C and 10K onto the intermediate transfer member 7 rotating around the support rollers to synthesize a color image on the intermediate transfer member 7.

A transfer material P stored in a sheet feeding cassette 21 of a sheet feeding apparatus 20 is fed by a sheet feeding unit (a first sheet feeding unit) 22. Then a color image is transferred onto the transfer material P (secondary transfer) after the transfer material P is passed through feeding rollers 23, 24 and 25, and a registration roller 26 (a second feeding unit).

A fixing apparatus 11 applies heat and pressure onto the transfer material P to fix the color toner image (or a monocolor toner image) on the transfer material P. The transfer material onto which the color toner image has been fixed is ejected from a sheet ejection roller 27 and placed on the sheet ejection tray 28 provided outside on the color image forming apparatus A.

On the other hand, after the secondary transfer unit 8 has transferred the color image onto the transfer material P, the intermediate transfer member 7 separates the transfer material P with separation by curvature. Then the residual toner left on the intermediate transfer member 7 is removed by a cleaning unit 6A.

<Primary Transfer Unit>

Figure 2:
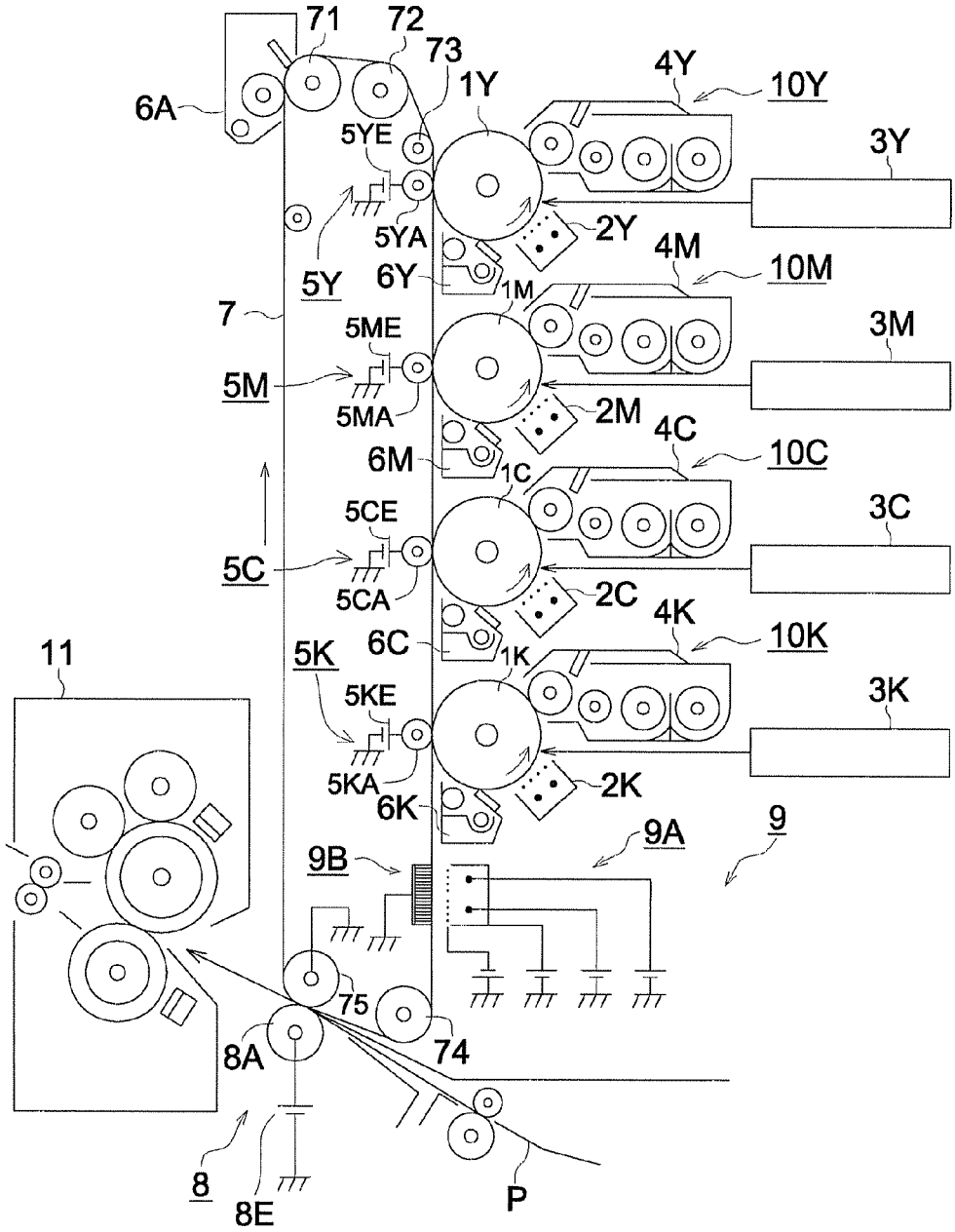
FIG. 2 illustrates a cross sectional view of a main area of the color image forming apparatus.

FIG. 2 illustrates a cross sectional view of the main portion of the color image forming apparatus A.

The primary transfer unit 5Y for transferring a yellow colored image, comprises a primary transfer roller 5YA and a voltage source 5YE for supplying voltage to the primary transfer roller 5YA. The primary transfer roller 5YA is opposed to the image carrier 1Y through the intermediate transfer member 7 and contacting to the inside of the intermediate transfer member 7. The voltage source 5YE is grounded.

The primary transfer unit 5M for transferring a magenta colored image, which comprises a primary transfer roller 5MA and a voltage source 5ME for supplying voltage to the primary transfer roller 5MA. The primary transfer roller 5MA is opposed to the image carrier 1M through the intermediate transfer member 7 and contacting to the inside of the intermediate transfer member 7. The voltage source 5ME is grounded.

The primary transfer unit 5C for transferring a cyan colored image comprises a roller 5CA and a voltage source 5CE for supplying voltage to the primary transfer roller 5CA. The primary transfer roller 5CA is opposed to the image carrier 1C through the intermediate transfer member 7 and contacting to the inside of the intermediate transfer member 7. The voltage source 5CE is grounded.

The primary transfer unit 5K for transferring a black colored image comprises a primary transfer roller 5KA and a voltage source 5KE for supplying voltage to the primary transfer roller 5KA. The primary transfer roller 5KA is opposed to the image carrier 1K through the intermediate transfer member 7 and contacting to the inside of the intermediate transfer member 7. The voltage source 5KE is grounded.

Each voltage sources 5YE, 5ME, 5CE and 5KE respectively supply current of 40 μA and voltage of +1.5 kV to the primary transfer units 5Y, 5M, 5C and 5K.

The primary transfer units 5Y, 5M, 5C and 5K are arranged to move away from the inside surface of the intermediate transfer member 7 by a driving unit (not shown) while the primary transfer units are not used for the primary transfer operation.

<Secondary Transfer Unit 8>

A secondary transfer unit 8 comprises a backup roller 75, a secondary transfer roller 8A and a voltage source 8E. The backup roller 8 structured by a conductive member opposes to the secondary transfer roller 8A through the intermediate transfer member 7 and contacts with the internal surface of the intermediate transfer member 7.

The backup roller 75 is connected with a voltage source 8E for applying voltage to the backup roller 75. The voltage source 8E applies current 50 μA and voltage +3 kV onto the secondary transfer unit 8. The voltage source 8E applies reverse bias voltage to move the residual toner adhered on the secondary transfer roller 8A contacting with the intermediate transfer member 7 onto the intermediate transfer member 7, to clean the secondary transfer roller 8A.

The backup roller 75 of the secondary transfer roller 8A has substantially the same configuration of the primary transfer rollers 5YA, 5MA, 5CA and 5KA, and contacts with the inside surface of the intermediate transfer member 7 with pressure. The backup roller 75 having a conductive characteristic comprises a main body of a roller and an elastic layer formed on the surface of the main body of the roller.

A single layer or a multiple layer belt having a material such as polyamide or polyimide structures the intermediate transfer member 7. The single layer or a multi layer belt has a volume resistivity of $10^7$-$10^{12}$ Ωcm.

The intermediate transfer member 7 is cleaned while passing through the cleaning unit 6A after the secondary transfer unit 8 has transferred the image onto the transfer material P.

The secondary transfer roller 8A is moved away from the inside surface of the intermediate transfer member 7 by a driving unit (not shown) while the secondary roller is not used for the secondary transfer operation.

<Pre-Secondary Transfer Discharge Unit 9>

In the color image forming apparatus of intermediate transfer method, even if a primary transfer performance is favorable for a primary color image, there may be cases where a failure secondary transfer of the secondary color image causes a problem of not being able to obtain a high quality image. This is caused by the fact that toner images formed on the intermediate transfer member 7 have a variety of toner adhesion amounts ranging from one layer of toners to four layers of toners, so that appropriate secondary transfer condition becomes different according to each adhesion amount of toners.

In order to solve this problem, a pre-secondary transfer discharge unit 9 pertaining to the present invention is provided at the position where the intermediate transfer member 7 is supported with a flat surface shape between the primary transfer unit 5K and a support roller 74, which are provided along with the intermediate transfer member 7.

Further by making an opposing electrode 9B made of an electro-conductive brush or an electro-conductive foamed member in surface contact with the intermediate transfer member 7, improvement of discharging efficiency can be achieved.

The pre-secondary-transfer discharge unit 9 comprises a discharger 9A provided in the image carrier side of the intermediate transfer member 7 and an opposing electrode 9B provided inside surface side of the intermediate transfer member 7 shaped in an endless belt.

Figure 3:
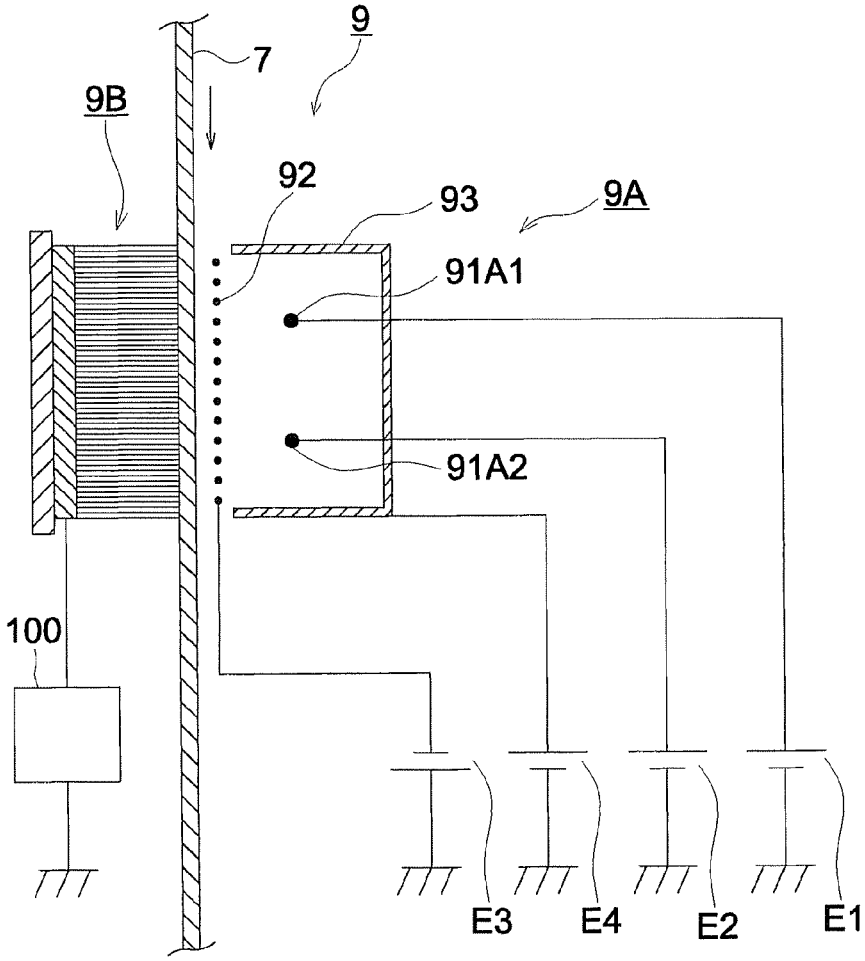
FIG. 3 illustrates a cross sectional view of a pre-secondary transfer discharge unit.

FIG. 3 shows a sectional view of the pre-secondary transfer discharge unit 9.

Discharge unit 9A disposed upstream in the rotation direction is a scorotron charger configured with discharging electrodes (discharging wires) 91A1, 91A2, a grid electrode 92 and a side plate 93.

The discharging electrode 91A1 is connected to a voltage source (voltage applying unit) E1. The discharging electrode 91A2 is connected to a voltage source (voltage applying unit) E2. The grid electrode is so disposed as to oppose to the belt surface of the intermediate transfer member 7 with keeping a predetermined distance. The grid electrode is connected to the voltage source (voltage applying unit) E3. The side plate 93 is connected to the voltage source (voltage applying unit) E4.

To the discharging electrodes 91A1 and 91A2, a voltage which allows discharge of reverse polarity with the charge polarity of the toner is applied. To the grid electrode 92, a voltage which allows discharge of the same polarity with the charge polarity of the toner is applied. To the side plate 93, a voltage which allows discharge of reverse polarity with the charge polarity of the toner is applied.

The opposing electrode 9B configured by a conductive blush and a pressure contact release mechanism for releasing pressure contact of the conductive blush is provided inside surface of the intermediate transfer member 7 opposed to the discharging unit of the pre-secondary transfer discharge unit 9. The conductive blush is contacted with the inside surface of the intermediate transfer member 7 with rubbing contact and grounded.

Usually, the same shaped discharge unit 9A is provided as the scorotron charger that being used for charging the image carrier.

A wire material of tungsten, stainless steal and gold having a diameter of 20-150 μm may be used for the discharging electrodes 91A1, 91A2. However, a wire material having the surface covered by gold is preferably used for the discharging electrode. The wire itself may be structured by gold or may be structured by a base material of stainless steal or tungsten, which is covered with gold layer thereon. The thickness of the gold layer is preferably 1 μm-5 μm in average thickness of the membrane from the viewpoints of the removal efficiency of substances generated by discharging such as ozone, a manufacturing cost and discharging efficiency.

With regard to the grid electrode 92, a wire type grid, a plate shaped grid formed from a pattern shape into which a metal plate is processed by an etching and a plate type grid onto which gold plating has been applied are used.

It is preferable that the conductive blush comprises a conductive resin material such as acryl, nylon and polyester. It is also preferable that the wire diameter 0.111 tex to 0.778 tex, where tex is proposed by ISO for the unit of measurement of the diameter of wire by representing the number of the length, which can be prolonged from a predetermined fixed weight material of the wire, the blush density is 12000 pieces of wire/$cm^2$ to 7700 pieces of wire/$cm^2$ and the original string electric resistivity is $10^0$ to $10^5$ Ωcm.

<Cleaning Unit of the Grid Electrode>

Figure 4:
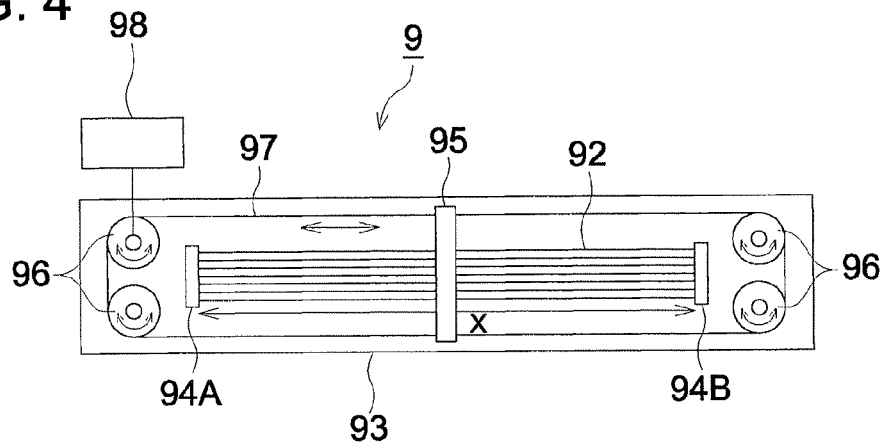
FIG. 4 illustrates a front elevation view of a pre-secondary transfer discharge unit provided with a cleaning unit of a grid electrode.

FIG. 4 illustrates a front elevation view of a cleaning unit of the grid electrode 92.

The scorotron charging unit used as the discharging unit 9A is provided with a cleaning unit for the grid electrode 92. The cleaning unit scrapes off the toners adhered on the grid electrode 92 by pressing the cleaning member 95 onto the grid electrode 92 from the side of charging electrodes 91A1 and 91A2, and reciprocally moving in the longitudinal direction (X direction in the figure) of the electrode.

The grid electrode 92 is suspended between holding members 94A and 94B with being spring-biased. The cleaning member 95 is formed of a soft material such as a brush. The cleaning member 95 is connected to a driving wire 97 which is wound about a plurality of pulleys 96. A driving unit 98 reciprocally moves the cleaning member 95 along a guide member (not shown) through the driving wire 97 by rotating the pulley 97 connected to the driving unit 98 in forward and reverse rotation direction.

Regarding the cleaning brush, the brush is used which is made of fluorine fiber having a length of 2 mm, a diameter of 10 T (tex) and a density of 30 kF/$inch^2$. Here, kF denotes kilo F, and F denotes filament number.

Figure 5:
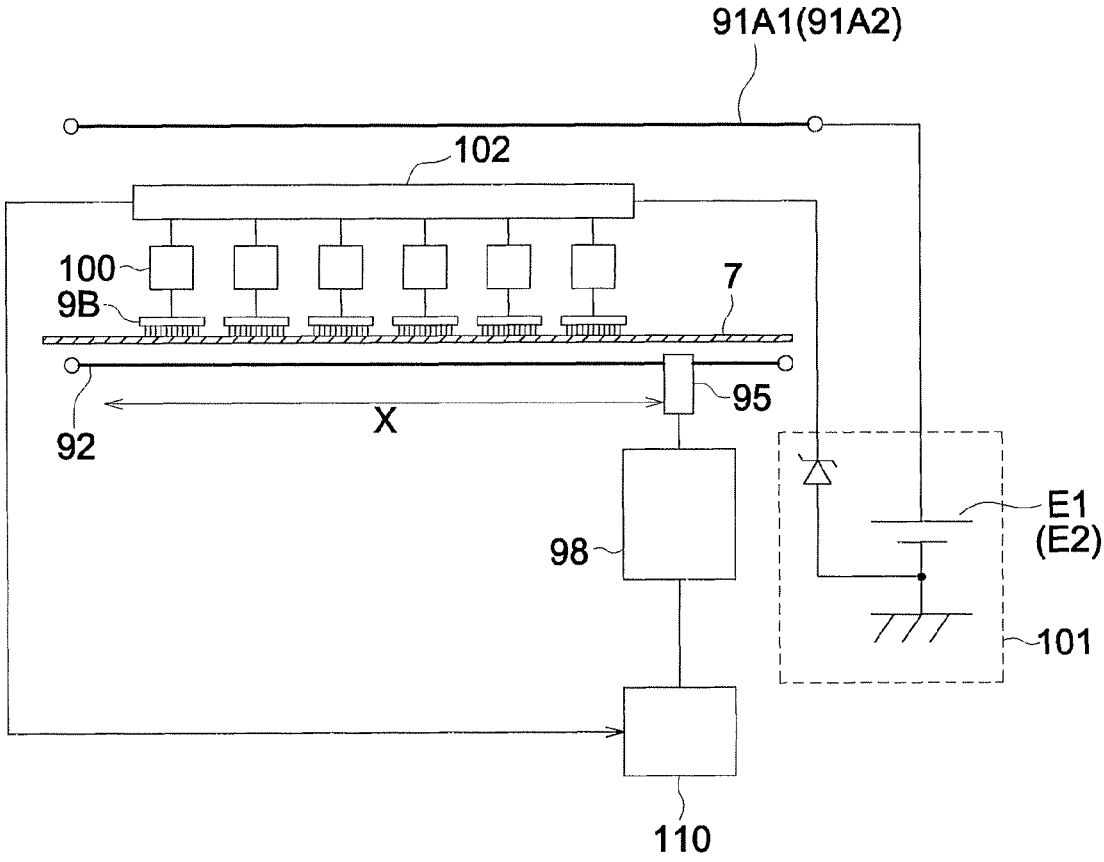
FIG. 5 illustrates a schematic view showing a configuration of a cleaning unit control.

FIG. 5 illustrates a schematic view showing a configuration of a cleaning unit control.

The grid electrode 92 is configured to a mesh shape structure comprising opening portions and closed potions. Opposing to the grid electrode, a plurality of detecting units 100 is disposed.

The discharging electrode 91A1 and 91A2, and the grid electrode 92, the detecting unit 100 are connected to the power source 101 to configure a closed circuit. Due to this, the discharging current detected by the detecting unit 100 can be supplied to the power source 101.

Near the cleaning member 95, a comparison operation unit 102 is disposed. The comparison operation unit compares the current value flowing from the grid electrode 92 before being cleaned by the cleaning member 95 into the opposing electrode 9B and the current value flowing from the grid electrode 92 after having been cleaned by the cleaning member 95 into the opposing electrode 9B. The comparison operation unit is connected to the detecting unit 100.

The comparison operation unit 102 is connected to the controller 110 and the driving unit 98, and outputs a cleaning signal for driving the cleaning member 95 to the driving unit 98.

After processing the detected current value, when the comparison operation unit 102 determines that the detected current value has a prescribed dispersion or the detected current value is less than a prescribed threshold value, a control signal is outputted from the controller 110 to the driving unit 98. When the controller 110 outputs the control signal to the driving unit 98 the cleaning member 95 moves along the grid electrode 92 to clean the grid electrode 92.

Further, after the cleaning by the cleaning member 95, the detecting unit 100 detects the current value of the grid electrode 92, and the comparison operation unit 102 processes the detected current value, and determines if the detected current value has the prescribed dispersion or the current value is less than the prescribed threshold value.

When the comparison operation unit has determined that the detected current value is not less than the prescribed threshold value, it is determined that the cleaning effect is achieved, and the cleaning process completes.

On the other hand, when the comparison operation unit has determined that the detected current value has the prescribed dispersion of the current value, or the current value is less than the prescribed threshold value, it is determined that the grid electrode has come to the end of its durability life.

In this case, by setting the absolute value of the applied voltage to the grid electrode at the time when the detecting unit 100 detects the current value flowing to the opposing electrode greater than the absolute value of the applied voltage at the time of pre-secondary transfer discharge process, the detecting sensitivity of the detecting unit 100 connected to the opposing electrode 9B can be improved.

Further, it is possible to divide the opposing electrode 9B in the width direction perpendicular to the moving direction of the intermediate transfer member 7, to detect each current value to the plurality of divided opposing units 9B, and to control the timing for cleaning the grid electrode based on distribution of these detected current values. Namely, in accordance with the current value detected by the detecting unit 100, the drive timing of the cleaning unit to clean the grid electrode 92 is controlled.

By this way, in cases where patterns in which images are localized in the longitudinal direction (X direction in the figure) are continuously outputted, or where the degree of dirt on the grid electrode 92 in the longitudinal direction is greatly different, the above control method can be effectively applied.

The electric current detection of the opposing electrode 9B by the detecting unit 100 is performed at the interval area between images formed on the intermediate transfer member 7, namely at the non-image area.

EXAMPLES

The present invention will be concretely described below by presenting the Examples. However, the present invention is not limited to the examples.

<Image Forming Condition>

Image forming apparatus: A tandem type full color copier (Konica Minolta 8050 (Trademark of Konica Minolta Co., Ltd) with some modifications), the continuous copy speed in full color mode is 51 sheets of copy (A4 size) per minute.

Figure 6:
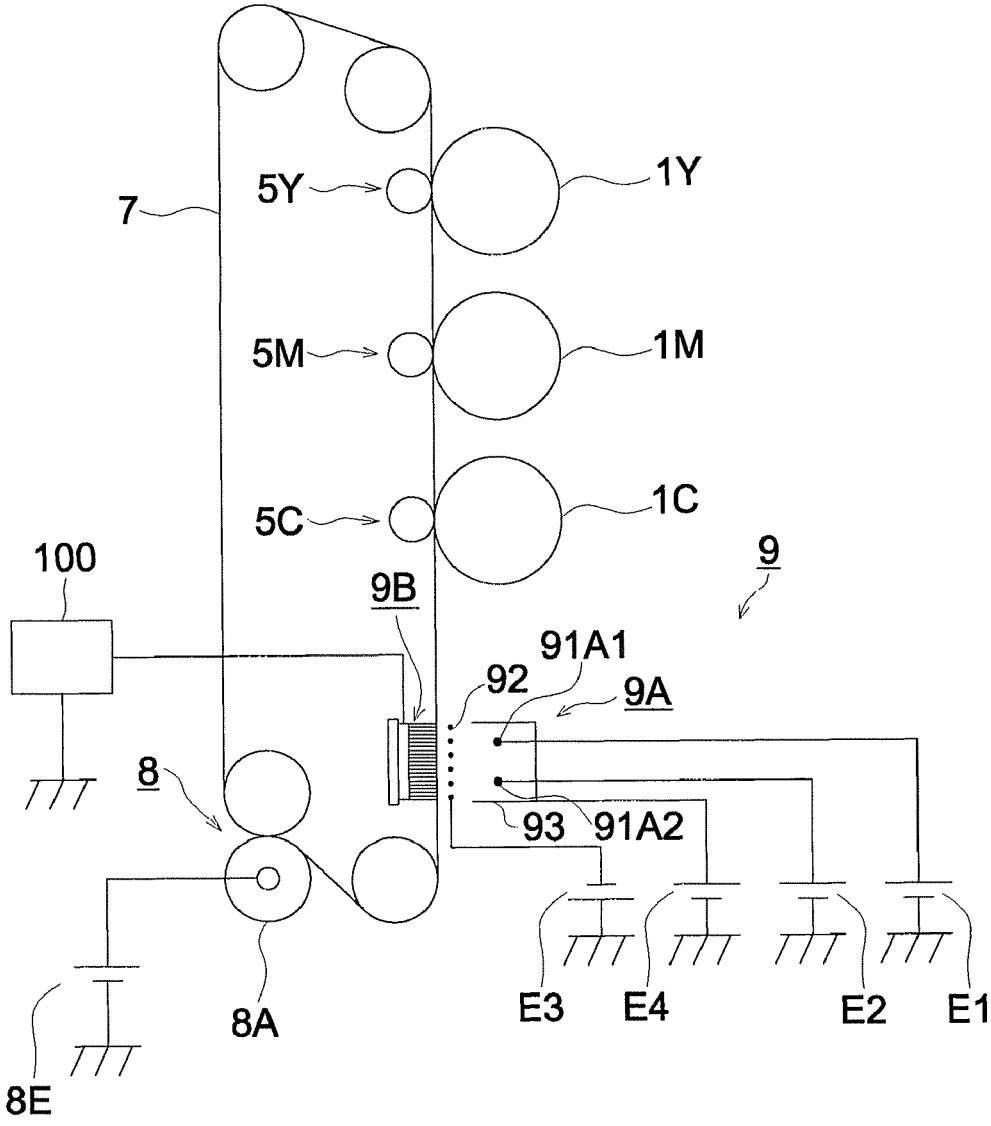
FIG. 6 illustrates a schematic diagram of the main area of a modified model of full color copier.

FIG. 6 illustrates a schematic diagram of the main portion of the modified model of the full color copier.

In these Examples, for confirming the effect of the invention, the color image forming apparatus A is used to form images, where primary transfer units 5Y, 5M, 5C, and the secondary transfer unit 8 shown in FIG. 2 are provided, and the pre-secondary transfer discharge unit 9 relating to the present invention is provided at the space where the image carrier 1K, the charging unit 2K, and the cleaning unit 6K disposed in the image forming section 10K are removed.

Image carrier 1Y, 1M, and 1C: The outer diameter is ϕ60 mm.

Transfer member conveyance line speed: 220 mm/sec

Developer: Average particle diameter of the carrier; 20-60 μm, average particle diameter of the polymerized toner; 3-7 μm Charging unit 2Y, 2M, and 2C: electrostatic charge voltage V0 is −700 V Exposing unit 3Y, 3M, and 3C: semiconductor laser (wavelength 780 nm), surface voltage potential of an image carrier after exposed is −50 V.

Developing unit 4Y, 4M, and 4C: Developing sleeve voltage Vdc is −500 V, Developing bias voltage alternate voltage element Vac is 1 kVp-p with a rectangular waveform of frequency 5 kHz.

Primary transfer rollers 5YA, 5MA, and 5CA: conductive rollers are used, roller pressure 50 N, transfer current 40 μA, and transfer voltage +1.5 kV is applied.

The secondary transfer unit: A configuration of sandwiching the intermediate transfer member 7 between the backup roller 75 and the secondary transfer roller 8A is adopted; Electrical resistances are both $1\times10^7\Omega$; applied are predetermined current values selected from a current value table in which a matrix being formed by temperature/humidity and counter values.

Pressure force F of the secondary transfer unit: 50N (Newton), Nip width in a transfer material conveyance direction: 3 mm Elastic layer of secondary transfer roller 8A: Semi-conductive NBR solid rubber (acrylonitrile•butadiene-rubber), volume resistance $4\times10^7\Omega$, and outer diameter ϕ40 mm.

Length in the axis direction of elastic layer of secondary transfer roller 8A: LA=150 mm, LB=250 mm, LC=330 mm Intermediate transfer member 7: Polyimide (PI) seamless semi-conductive belt, volume resistance $10^9\Omega$, surface resistance $10^{11}\Omega$, stretched tension 50N, line velocity 220 mm/sec The discharging electrodes 91A1, 91A2 are coupled to the power source E1 of high voltage and the power source E2 of high voltage, respectively, so as to apply electric currents in a range of 0-400 μA to the discharging electrodes 91A1, 91A2. The grid electrode 92 is coupled to the power source E3 of high voltage, so as to apply electric currents in a range of 0--300 μA to the grid electrode 92. The side plate 93 is insulated from the grid electrode 92, and is so constituted that a voltage in a range of 50-300 V can be applied to the side plate 93. Further, the opposing electrode 9B disposed opposite to the discharger 9A is coupled to the ground.

It is configure such that the discharging electrode 91A1 can be applied a voltage for reverse discharge polarity to the polarity of toner image through the power source E1, the discharging electrode 91A2 can be applied a voltage for reverse discharge polarity to the polarity of toner image through the power source E2, and the grid electrode 92 can be applied a voltage for the same discharge polarity as the polarity of toner image through the power source E3.

In the present embodiment, the discharging electrodes 91A1 and 91A2 are applied with voltages of reverse polarity to the charge polarity of the toner image, while the grid electrode 92 is applied with a voltage of the same polarity as the charge polarity of the toner image.

In the present Examples, with respect to the toner image having negative charges, the discharging electrodes 91A1 and 91A2 of the pre-secondary transfer discharge unit are applied positive voltages, the grid electrode 92 is applied a negative voltage, and the side plate 93 is applied a positive voltage.

The grid electrode 92 and the intermediate transfer member 7 are disposed in parallel with a gap of 1 mm.

The distance between the discharging electrodes 91A1, 91A2 (the interval of them in the moving direction of the intermediate transfer member 7) is set at 30 mm, while the length in a longitudinal direction of the discharging electrodes 91A1, 91A2 (the length in the direction perpendicular to the moving direction of the intermediate transfer member 7) is set at 320 mm.

The electric current value supplied from the power sources E1, E2 to the discharging electrodes 91A1, 91A2 is set at 350 μA, the distance between the discharging electrodes 91A1, 91A2 and the grid electrode 92 is set at 8 mm, and the distance between the discharging electrodes 91A1, 91A2 and the side plate 93 is set at 8 mm. The aperture ratio of the grid electrode 92 is 90%, while the electric potential of the opposing electrode 9B is 0 V.

The opposing electrode 9B including an electro-conductive brush, which is mechanically coupled to a press-contact release mechanism (not shown in the drawings) for press-contacting and releasing the conductive brush to/from the intermediate transfer member 7, is disposed at inner side of the intermediate transfer member 7, so as to oppose to the discharger 9A.

The electro-conductive brush employed in this example has the specification indicated as follow.

Electro-resistance of original fiber: $10^2\Omega$

Diameter of each fiber: 3 denier (degree of fineness at a length of 4560 m and a mass of 50 mg is defined as 1 denier)

Density: 200 kF/inch$^2$ (F is a number of filaments, 1 inch is 25.4 mm)

Fiber length: 3 mm

The width of the electro-conductive brush of the opposing electrode 9B (namely, its length in the moving direction of the intermediate transfer member 7) is set at 30 mm, while the length of the conductive brush in its longitudinal direction (namely, its length in the direction perpendicular to the moving direction of the intermediate transfer member 7) is set at 320 mm.

Examples and Comparative Examples

TABLE 1

| Amount of dirt on grid electrode 92 | | non | very small | small-medium | medium | large |
|---|---|---|---|---|---|---|
| Humidity 20% | Current into opposing electrode (μA) | 1 | 3 | 12 | 17 | 29 |
| | Halftone image | good | good | good | bad | bad |
| Humidity 50% | Current into opposing electrode (μA) | 2 | 5 | 16 | 23 | 36 |
| | Halftone image | good | good | good | bad | bad |
| Humidity 80% | Current into opposing electrode (μA) | 2 | 6 | 20 | 27 | 41 |
| | Halftone image | good | good | good | bad | bad |

The electric current value flowing into the opposing electrode 92B increases in accordance with the amount of dirt on the grid electrode 92. In order to determine the electric current value where roughening of halftone image is generated, by setting the humidity in three conditions, obtaining the electric current flowing into the opposing electrode 9B and the amount of dirt on the grid electrode 92 is determined as shown in the Table 1.

TABLE 2

| Humidity | Threshold current value |
|---|---|
| lower than 30% | 15 μA |
| 30%-60% | 20 μA |
| higher than 60% | 25 μA |

Using the result shown in Table 1, the current value where roughening of halftone image starts is set as shown in Table 2.

TABLE 3

| | Image failure determination | | | |
|---|---|---|---|---|
| Image pattern | Example 1 | Comparative example 1 | Comparative example 2 | Comparative example 3 |
| (1) mono-color halftone image | good | good | good | good |
| (2) mono-color solid image | good | good | good | good |
| (3) two-color solid image | good | good | good | bad |
| (4) mono-color character/fine line image | good | good | bad | bad |
| (5) two-color character/fine line image | good | bad | bad | bad |

Note:
"bad" means generation of roughening image is observed.

Under the conditions of temperature 20% and humidity 50%, cleaning experiments of the grid electrode 92 have been conducted with the image patterns (1)-(5), as Example and Comparative examples shown in Table 3.

A patch for image evaluation is disposed in an area of each image pattern. Conditions for the pre-secondary transfer discharge are set as described below.

At the time of discharging the image area: Electric current from discharging wire is 300 μA, electric potential of the grid wire is −50 V, At the time of detecting the flow-in electric current: Electric current from discharging wire is 300 μA, Electric potential of the grid wire is −200 V.

Namely, the electric current from the discharging wire is set equal, and the absolute value of the electric potential of the grid wire at the time of detecting the flow-in electric current is greater than that of at the time of discharging the image area.

In the Example 1 and the Comparative examples 1, 2 and 3, the electric currents flowing to the opposing electrode 9B are detected by the detecting unit 100 in every 100 sheets of copy at the non-image area. And when the electric current greater than 20 μA is detected, cleaning operation of the grid electrode 92 is conducted by the cleaning member 95.

By the control described above, the cleaning was conducted as below. The timings when the cleanings were conducted are $4500^{th}$, $6500^{th}$, $7800^{th}$, $8500^{th}$ and $8800^{th}$ sheets of copy.

Regarding the image pattern, five types of image (1) mono-color halftone image, (2) mono-color solid image, (3) two-color solid image, (4) mono-color character/fine line image, and (5) two-color character/fine line image were set.

In the Example 1, with respect to the output for any of the above five image patterns no image failure was generated.

In the Comparative example 1, the cleanings were conducted by the cleaning member 95 at every 500 sheets of copy. And in the image pattern (5) of two-color character/fine line image, image roughening was generated.

In the Comparative example 2, the cleanings were conducted by the cleaning member 95 at every 1000 sheets of copy. And in the image patterns of (4) mono-color character/fine line image and (5) two-color character/fine line image, image roughening was generated.

In the Comparative example 3, the cleanings were conducted by the cleaning member 95 at every 2000 sheets of copy. And in the image patterns of (3) two-color solid image, (4) mono-color character/fine line image and (5) two-color character/fine line image, image roughening was generated.

If the cleaning is conducted in every smaller number of sheets of copy than 500 sheets, it may be predicted that the image failure will be decreased, however total number of cleaning times is increased and the problem is caused that the rate of non-operating state of the apparatus is increased.

Although an example of the image forming apparatus in which the belt-type intermediate transfer member is employed for the intermediate transfer member 7 has been described the present embodiment, it is needless to say that another type of the intermediate transfer member (for instance, a drum-type intermediate transfer member) can be also employed in the present invention.

According to the pre-secondary transfer discharging of the above-mentioned embodiment, by detecting the electric current value flowing into the opposing electrode and conducting the cleaning of the grid electrode at appropriate timings, prevented are decrease of the electric potential controllability due to the dirt on the electrode and generation of failure images such as image roughening.

Namely, by estimating the amount of dirt on the grid electrode from the current value flowing into the opposing electrode, and controlling the timing of cleaning operation, the image failure can be prevented even under the condition where the dirt increases rapidly. Further in the condition where the dirt increases very slowly, a useless operation of conducting the cleaning at the time when the dirt is still not generated can be prevented.

Further, by conducting the electric current detection at the non-image area, and setting the absolute value of the voltage applied to the grid electrode at the time of the detection greater than that of at the time of the pre-secondary transfer discharge, the sensitivity of electric current detection can be improved. Further, the method of electrically dividing the opposing electrode in the longitudinal direction, and controlling the cleaning timing in accordance with the electric current distribution in the longitudinal direction can be effectively applicable in cases where the amount of dirt on grid electrode differs greatly in the longitudinal direction such as the case where patterns in which image is localized in the longitudinal direction are continuously outputted.

Further, according to the present invention, the total electric charge amount at high electric potential area, namely the area of superimposed toners, can be decreased, while the electrical potential decrease at low toner adhesion amount area such as halftone area can be suppressed to small degree. Thus, the image roughening in the low toner adhesion amount area can be prevented, and good secondary transfer performance can be achieved also at the superimposed toner area.

What is claimed is:

1. An image forming apparatus comprising:

a primary transfer unit to primarily transfer toner images of a plurality of colors onto an intermediate transfer member, each of the toner images having been formed on a rotating image carrier;

a secondary transfer unit to secondarily transfer the toner images formed on the intermediate transfer member onto a transfer material; and a pre-secondary transfer discharge unit to discharge electrical charges of the toner images carried by the intermediate transfer member, wherein the pre-secondary transfer discharge unit comprises:

a scorotron charging unit having a grid electrode disposed to face the intermediate transfer member, and a discharging electrode;

an opposing electrode disposed to oppose the grid electrode through the intermediate transfer member;

a first voltage applying unit to apply a voltage of reverse polarity to a charge polarity of toners forming the toner images to the discharging electrode;

a second voltage applying unit to apply a voltage of same polarity as the charge polarity of the toners to the grid electrode;

a cleaning unit to clean the grid electrode;

a detecting unit to detect an electric current value flowing to the opposing electrode; and a controller to control a timing for the cleaning unit to clean the grid electrode, in accordance with the electric current value detected by the detecting unit.

2. The image forming apparatus of claim 1, wherein in a case the detecting unit detects that the electric current value flowing to the opposing electrode has varied with a prescribed value or more, the controller controls the cleaning unit to clean the grid electrode.

3. The image forming apparatus of claim 1, wherein in a case the detecting unit detects that the electric current value flowing to the opposing electrode is less than a prescribed threshold value, the controller controls the cleaning unit to clean the grid electrode.

4. The image forming apparatus of claim 1, wherein in a case the controller does not detect an effect of cleaning based on the electric current value detected by the detecting unit after the cleaning, the controller increases an absolute value of the voltage to be applied to the grid electrode.

5. The image forming apparatus of claim 1, wherein a timing when the detecting unit detects the electric current value flowing to the opposing electrode is set in a period when an area of no toner image on the intermediate transfer member passes through the detecting unit.

6. The image forming apparatus of claim 1, wherein the opposing electrode is divided into a plurality of elements in a direction perpendicular to a moving direction of the intermediate transfer member and parallel to a surface of the intermediate transfer member where the toner images are primary transferred.

* * * * *